US010781729B1

(12) United States Patent
Foster

(10) Patent No.: US 10,781,729 B1
(45) Date of Patent: Sep. 22, 2020

(54) SWITCHABLE ROCKER ARM

(71) Applicant: SCHAEFFLER TECHNOLOGIES AG & CO. KG, Herzogenaurach (DE)

(72) Inventor: Colin Foster, Belle River (CA)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/407,218

(22) Filed: May 9, 2019

(51) Int. Cl.

| | |
|---|---|
| ***F01L 13/00*** | (2006.01) |
| ***F01L 1/18*** | (2006.01) |
| ***F01L 1/22*** | (2006.01) |
| ***F01L 3/08*** | (2006.01) |
| *F01L 1/46* | (2006.01) |

(52) U.S. Cl.
CPC ..... *F01L 13/0021* (2013.01); *F01L 1/185* (2013.01); *F01L 1/22* (2013.01); *F01L 3/08* (2013.01); *F01L 2001/186* (2013.01); *F01L 2001/467* (2013.01)

(58) Field of Classification Search
CPC ... F01L 1/181; F01L 2001/186; F01L 1/2411; F01L 1/46; F01L 13/0005
USPC ..... 123/90.36, 90.39, 90.44, 90.46
See application file for complete search history.

(56) References Cited

U.S. PATENT DOCUMENTS

| | | | | |
|---|---|---|---|---|
| 7,225,776 | B2 | 6/2007 | Gecim et al. | |
| 8,915,225 | B2 | 12/2014 | Zurface et al. | |
| 9,926,816 | B2 | 3/2018 | Ahmed et al. | |
| 2013/0269652 | A1* | 10/2013 | Toth | F01L 1/181 123/323 |
| 2015/0252694 | A1* | 9/2015 | Gustafson | F01L 13/06 123/321 |
| 2017/0009610 | A1* | 1/2017 | Ahmed | F01L 1/2405 |
| 2017/0284237 | A1* | 10/2017 | Shewell | F01M 9/10 |
| 2018/0266282 | A1* | 9/2018 | Nagaraj | F01L 1/181 |

* cited by examiner

*Primary Examiner* — Jorge L Leon, Jr.
(74) *Attorney, Agent, or Firm* — Matthew Evans

(57) ABSTRACT

A switchable rocker arm is provided for a valve train of an internal combustion engine. The switchable rocker arm includes a first lever arranged to be rotated by a camshaft about a pivot, a second lever arranged to actuate an engine valve, and a locking part arranged to selectively lock the first lever to the second lever. The locking part is arranged to be mechanically actuated by the pivot.

18 Claims, 9 Drawing Sheets

SWITCHABLE ROCKER ARM

TECHNICAL FIELD

The present invention relates to a switchable rocker arm for a valve train of an internal combustion (IC) engine.

BACKGROUND

Rocker arms are utilized within valve trains of IC engines to facilitate translation of rotary motion of a camshaft to linear motion of an intake or exhaust valve. Switchable rocker arms can facilitate different intake or exhaust valve lifts to achieve greater engine efficiency or power. Switchable rocker arms can employ a locking part that can be selectively actuated to switch between lift modes, which can include a no lift mode, low lift mode, and a full lift mode. Minimized packaging space and consistent switching times are two desired characteristics of switchable rocker arm systems.

SUMMARY

A switchable rocker arm that rotates about a pivot is provided for a valve train of an internal combustion engine. The switchable rocker arm includes a first lever, a second lever, and a locking part. The locking part is arranged to selectively lock the first lever to the second lever. The locking part is arranged to be mechanically actuated by the pivot, or, stated otherwise, arranged to be actuated by rotation of the pivot. The locking part can include a locking pin, a shuttle pin, and a bias spring. One or both of the locking pin and the shuttle pin can have a flat that is configured to engage the first or second lever. The locking pin is arranged at least partially within a locking pin bore of the first lever, and the shuttle pin is arranged at least partially within a shuttle pin bore of the second lever, with the locking pin engaging the shuttle pin.

The first cam lever can have a first cam end with a cam interface and a second locking end. The cam interface can be in the form of a roller follower or a slider pad. The first cam lever can further include a cam pivot interface arranged between the first cam end and the second locking end.

The second valve lever can have a first pivot end and a second valve end. The second valve end can include a hydraulic lash adjuster or an adjusting screw. The second valve lever can further include a first arm with a first pivot interface, and a second arm with a second pivot interface. The cam pivot interface can be axially aligned with the first and second pivot interfaces.

The switchable rocker arm can have: a first locked position with the first cam lever locked to the second valve lever, defining a first lift mode; and a second unlocked position with the first lever unlocked to the second lever, defining a second lift mode. The first lift mode can be a full-valve-lift mode, and the second lift mode can be a no-valve-lift mode.

The switchable rocker arm can have a resilient finger arranged at a first end of the locking pin bore. The resilient finger can be configured to actuate the locking pin upon rotation of the pivot.

A valve train system is provided that includes a pivot, at least one first switchable rocker arm arranged to rotate about the pivot, and at least one second switchable rocker arm arranged to rotate about the pivot. The at least one first switchable rocker arm has a first locking part arranged to be mechanically actuated by the pivot, and the at least one second switchable rocker arm has a second locking part arranged to be mechanically actuated by the pivot. The pivot can be a shaft that includes: a first protrusion that actuates the first locking part; and, a second protrusion that actuates the second locking part. The first protrusion can be at a first angular position, and the second protrusion can be at a second angular position which is different than the first angular position. The shaft can have an outer shaft and an inner shaft, with the outer shaft including the first protrusion, and the inner shaft including the second protrusion. The outer shaft can rotate to mechanically actuate the at least one first switchable rocker arm, and the inner shaft can rotate to mechanically actuate the at least one second switchable rocker arm.

BRIEF DESCRIPTION OF THE DRAWINGS

The foregoing Summary as well as the following Detailed Description will be best understood when read in conjunction with the appended drawings. In the drawings.

DETAILED DESCRIPTION OF THE EMBODIMENTS

Figure 1:
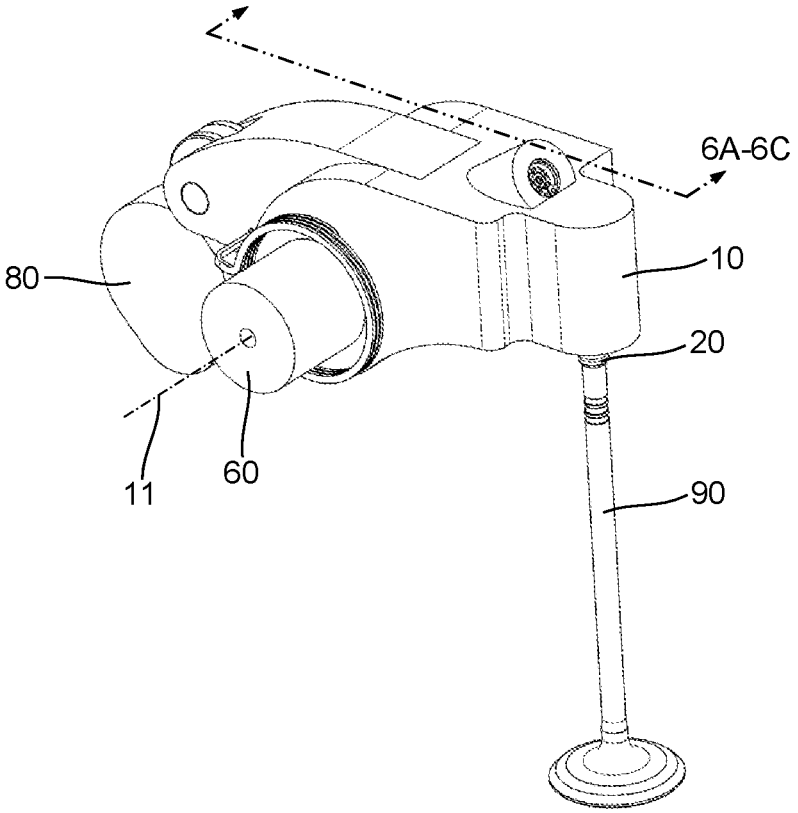
FIG. 1 is a perspective view of a first embodiment of a switchable rocker arm together with a pivot, an engine valve, and a camshaft.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, c or combinations thereof. The terminology includes the words specifically noted above, derivatives thereof, and words of similar import.

Figure 2:
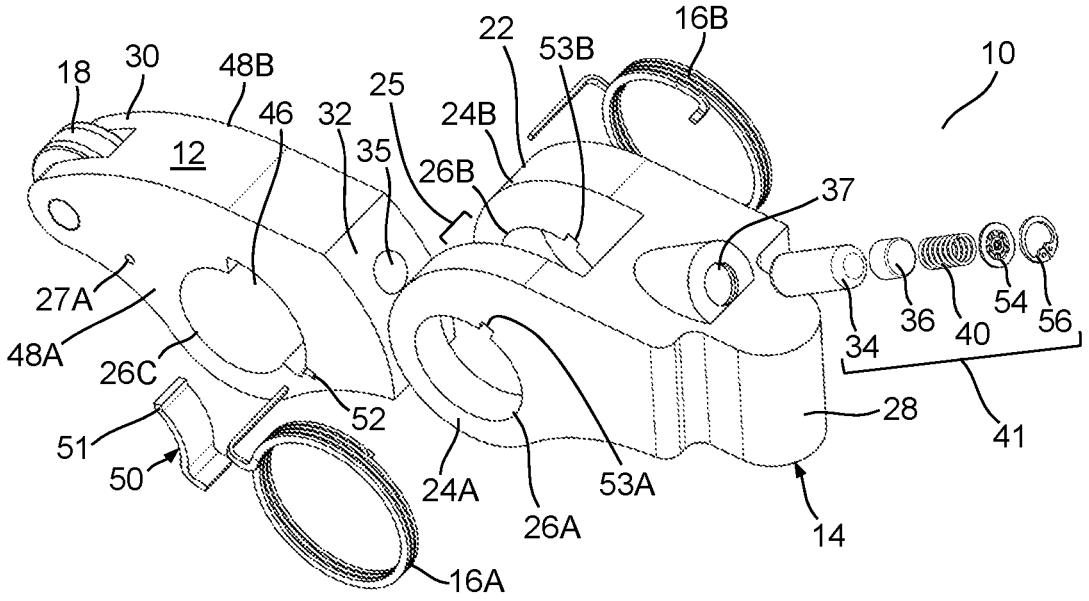
FIG. 2 is an exploded perspective view of the switchable rocker arm of FIG. 1.
Figure 3A:
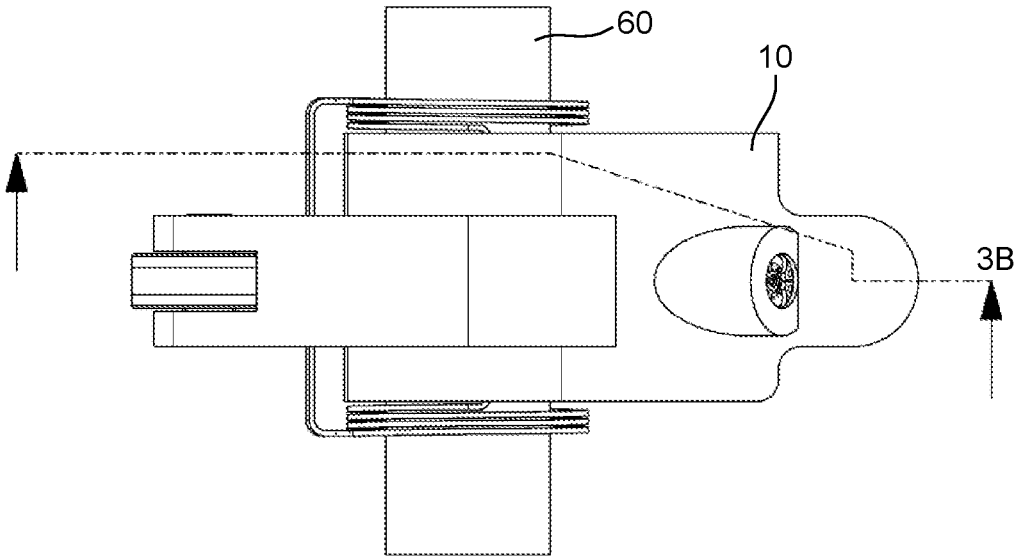
FIG. 3A is a top view of the switchable rocker arm and pivot of FIG. 1.
Figure 3B:
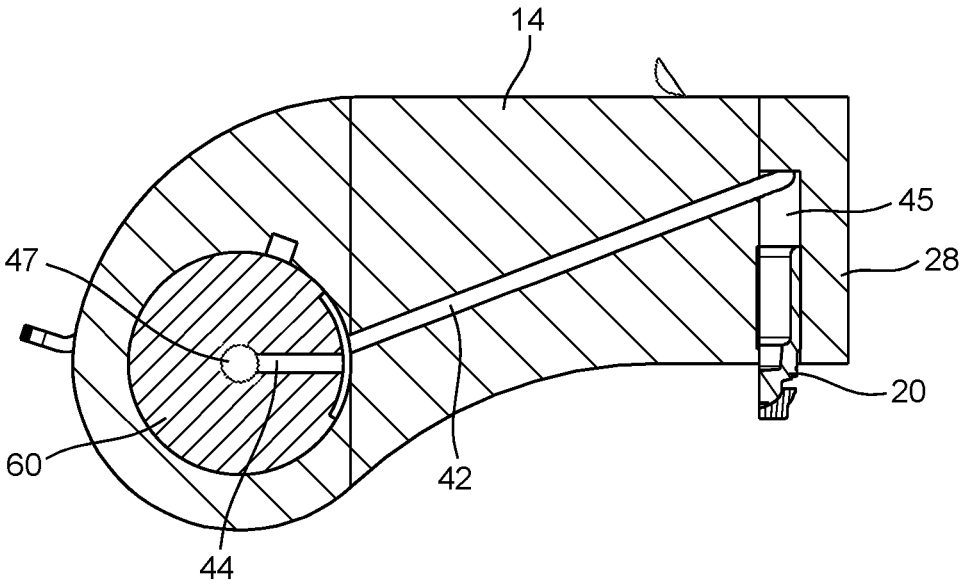
FIG. 3B is a cross-sectional view taken from FIG. 3A.
Figure 4:
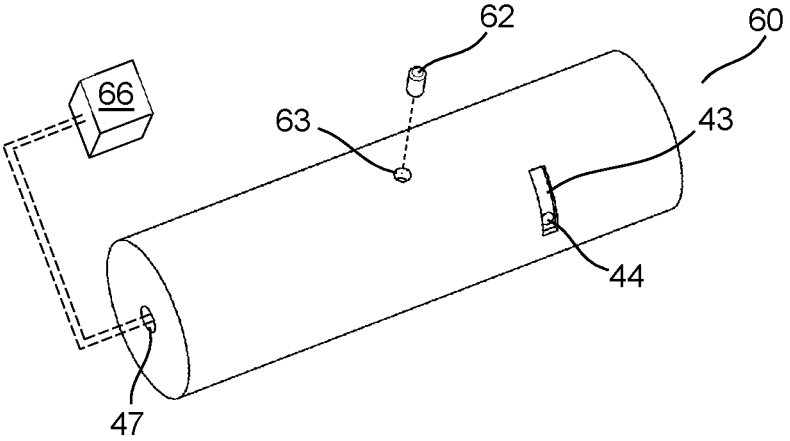
FIG. 4 is a perspective view of the pivot of FIG. 1.
Figure 5:
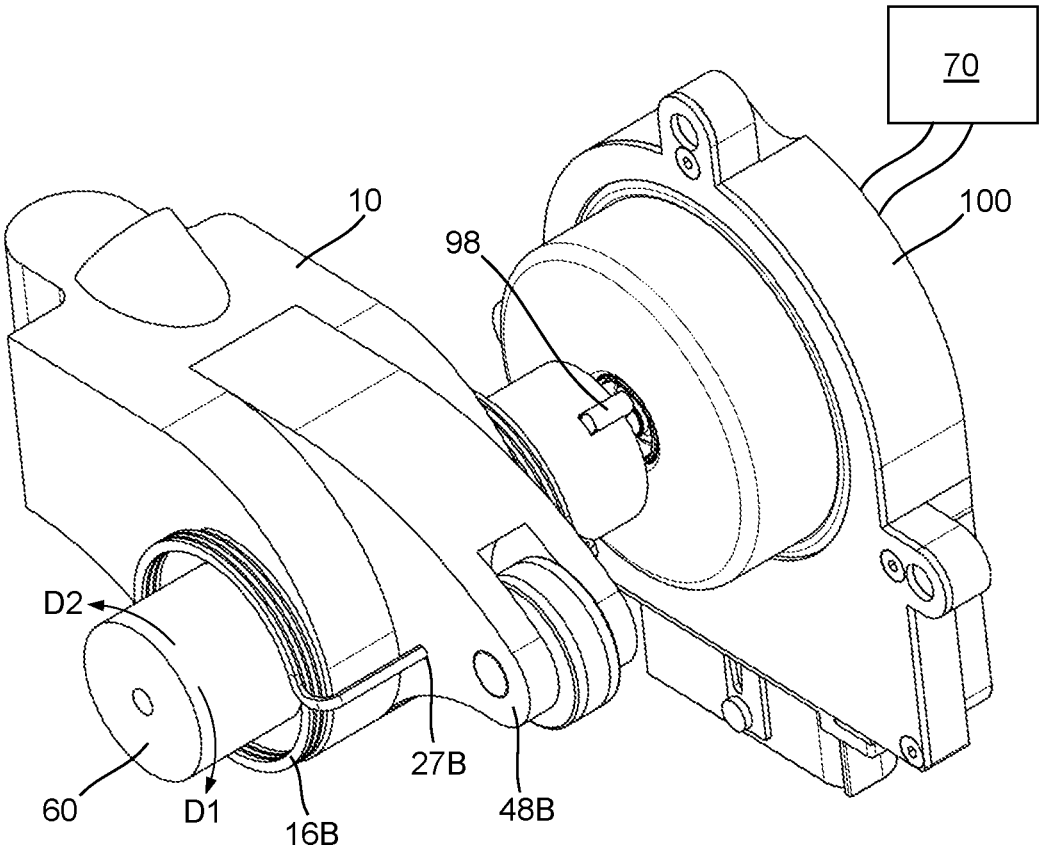
FIG. 5 is a perspective view of the pivot and switchable rocker arm of FIG. 1 together with an actuator.
Figure 6A:
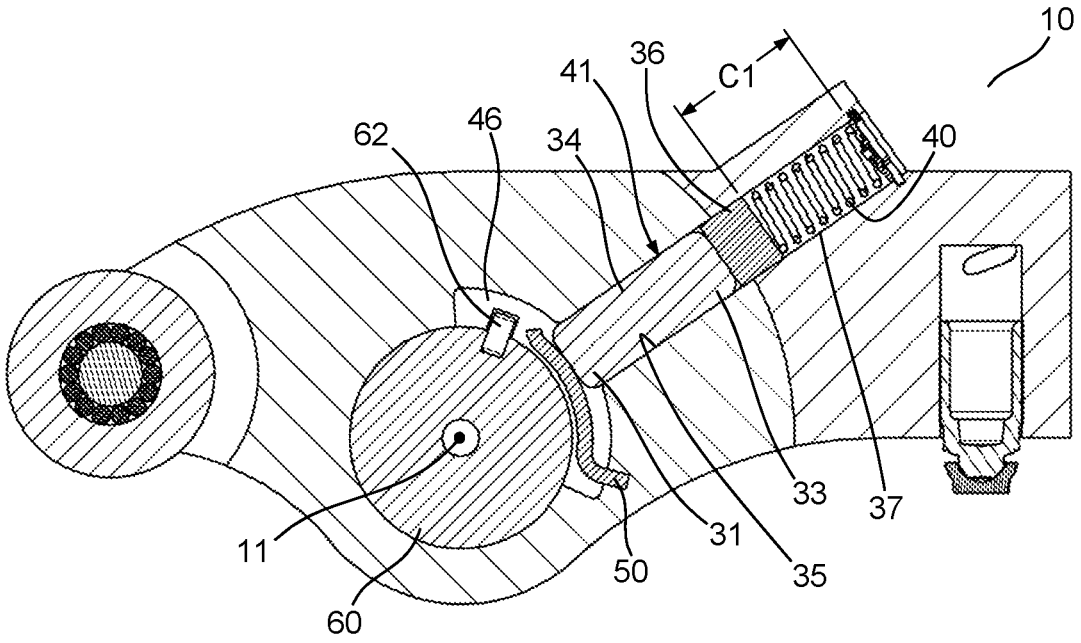
FIG. 6A is a cross-sectional view taken from FIG. 1, showing the rocker arm with a disengaged-locked locking part arrangement in a first locked position.
Figure 6B:
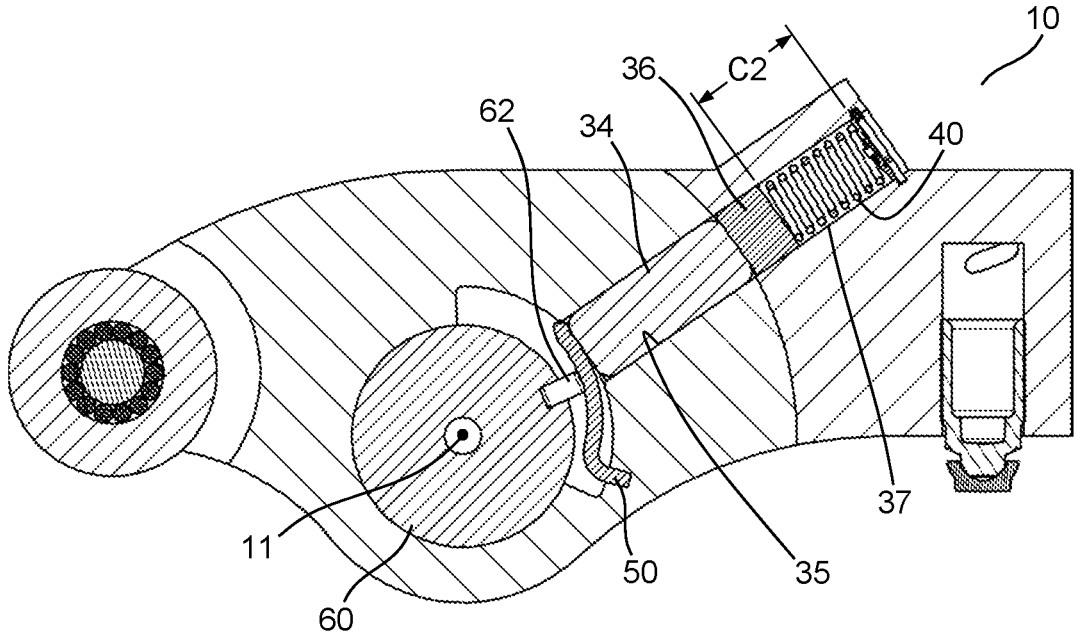
FIG. 6B is a cross-sectional view taken from FIG. 1, showing the rocker arm with the disengaged-locked locking part arrangement in a second unlocked position.
Figure 6C:
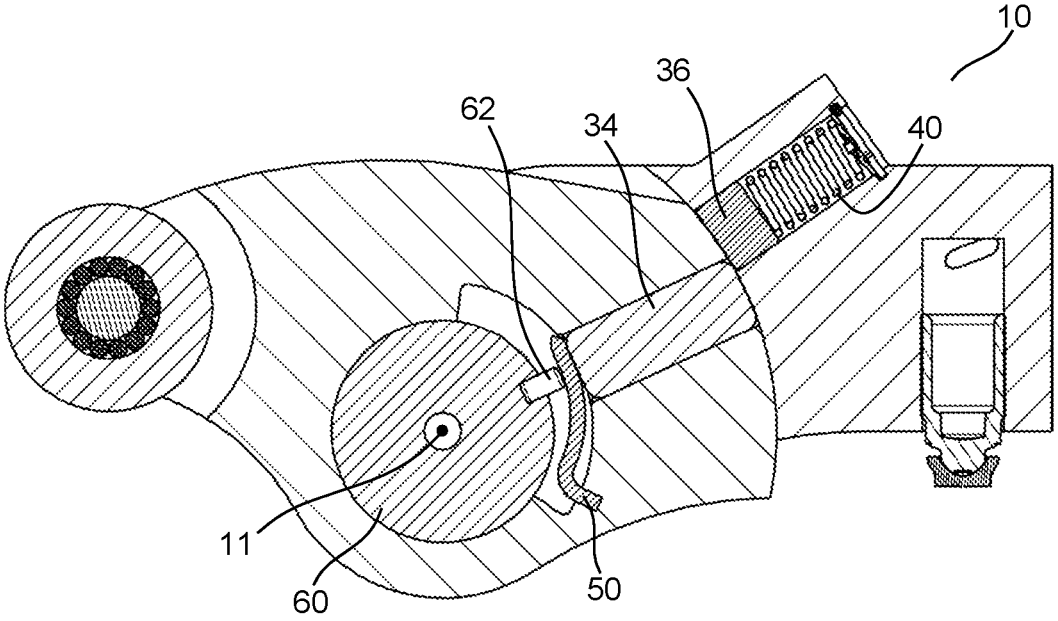
FIG. 6C is a cross-sectional view taken from FIG. 1, showing a lost motion position of the switchable rocker arm with the disengaged-locked locking part arrangement in the second unlocked position.

FIG. 1 shows a perspective view of a first embodiment of a switchable rocker arm 10 together with a pivot 60, a pivot axis, 11, a camshaft 80, and an engine valve 90. Rotary motion of the camshaft 80 causes the switchable rocker arm 10 to rotate about the pivot 60 and respective pivot axis 11 to actuate the engine valve 90. FIG. 2 shows an exploded perspective view of the switchable rocker arm 10 of FIG. 1. FIG. 3A shows a top view of the switchable rocker arm 10 of FIG. 1, and FIG. 3B shows a cross-sectional view taken from FIG. 3A. FIG. 4 shows a perspective view of the pivot 60 of FIG. 1. FIG. 5 shows a perspective view of the switchable rocker arm 10 and pivot 60 of FIG. 1 together with an actuator 100. FIGS. 6A through 6C show cross-sectional views of the switchable rocker arm 10 with a locking part 41 in different longitudinal positions to achieve different valve lift modes. The following discussion should be read in light of FIGS. 1 through 6C.

The switchable rocker arm 10 can switch between at least two discrete valve lift modes. The components of the switchable rocker arm 10 include a first cam lever 12, a second valve lever 14, a first lost motion spring 16A, and a second lost motion spring 16B. Those familiar with switchable valve train components are aware that various forms of lost motion springs are possible.

The second valve lever 14 includes a first pivot end 22 with a first arm 24A and a second arm 24B, such that the first arm 24A is axially offset from the second arm 24B, creating a space or passage 25 in between the two arms 24A, 24B. The first arm 24A includes a first rocker shaft bore 26A and the second arm 24B includes a second rocker shaft bore 26B. A first retainer slot 53A for an end of the first lost motion spring 16A is arranged on the first arm 24A, and a second retainer slot 53B for the second lost motion spring 16B is arranged on the second arm 24B. The first and second retainer slots 53A, 53B also provide clearance to one or more protruding features on the pivot 60; the protruding features are further described in the following paragraphs. A second valve end 28 of the second valve lever 14 has a valve interface 20 in the form of a hydraulic lash adjuster which can receive hydraulic fluid via a bore 45 which is fluidly connected to a lever fluid passage 42 that extends from the second rocker shaft bore 26B. The lever fluid passage 42 of the second valve lever 14 is fluidly connected with a radial fluid passage 44, which is fluidly connected to an axial fluid passage 47 that receives hydraulic fluid from a pressurized fluid source 66 such as an oil pump of the IC engine. Both the radial fluid passage 44 and the axial fluid passage 47 are arranged within the pivot 60. Other fluid passage arrangements that serve the purpose of providing hydraulic fluid to the switchable rocker arm 10 are also possible.

The first cam lever 12 includes a first cam end 30 with a cam interface in the form of a roller follower 18, and a second locking end 32 with a locking pin bore 35. A third rocker shaft bore 26C is present at a medial position on the first cam lever 12. The first cam lever 12 fits within the space or passage 25 created by the two arms 24A, 24B of the second valve lever 14, such that the first arm 24A extends along a first longitudinal side 48A of the first cam lever 12, and the second arm 24B extends along a second longitudinal side 48B of the first cam lever 12. In addition, the third rocker shaft bore 26C is in axial alignment with the first and second rocker shaft bores 26A, 26B of the first and second arms 24A, 24B, respectively, of the second valve lever 14. A first retainer aperture 27A for one end of the first lost motion spring 16A is arranged on the first longitudinal side 48A, and a second retainer aperture 27B for one end of the second lost motion spring 16B is arranged on the second longitudinal side 48B.

The switchable rocker arm 10 captured in FIGS. 1 through 6C can switch between at least two discrete valve lift modes, achieved by different longitudinal positions of the locking part 41. The locking part 41 includes a locking pin 34, a shuttle pin 36, a bias spring 40, a retention cap 54, and a retaining ring 56. Different forms of the locking part 41 are possible, which may include additional or less components. The different longitudinal positions of the locking part 41 are achieved by rotation of the pivot 60; or more specifically, by rotation of a protrusion 62 arranged on the pivot 60 that can engage a resilient finger 50 arranged within a radial inner recess 46 formed around the third rocker shaft bore 26C of the first cam lever 12. Therefore, the locking part 41 is mechanically actuated by the pivot 60, as opposed to being actuated by hydraulic fluid. The resilient finger 50 can be retained via a reception groove 52 formed within a wall of the radial inner recess 46; however, other retention means are also possible. The resilient finger 50 has a distal end 51 that is proximate to a radial inward end of the locking pin bore 35. Referring now to FIG. 6A, a first locked position is shown at which the locking pin bore 35 of the first cam lever 12 is axially aligned with the shuttle pin bore 37 of the second valve lever 14, enabling engagement of the shuttle pin 36 with both the first cam lever 12 and the second valve lever 14. The first locked position can facilitate a full-valve-lift mode such that when the first cam lever 12 is rotationally actuated by the camshaft 80 (FIG. 1), the second valve lever 14 rotates in unison with the first cam lever 12 about the pivot axis 11. In the first locked position, the locking pin bias spring 40 or resilient element with a first compressed length C1, urges the locking pin 34 with a pre-load force to its shown position in FIG. 6A.

Referring now to FIG. 6B, a second unlocked position is shown in which the shuttle pin 36 is moved from the locking pin bore 35. This occurs when the protrusion 62 acts on a first end 31 of the locking pin 34 via the resilient finger 50, displacing the locking pin 34 radially outwardly within the locking pin bore 35. As a second end 33 of the locking pin 34 is engaged with the shuttle pin 36, this displacement of the locking pin 34 causes the shuttle pin 36 to move radially outwardly within the shuttle pin bore 37 until it disengages the locking pin bore 35. In the second unlocked position, the bias spring 40 compresses to a second compressed length C2 that is shorter than the first compressed length C1 in the first locked position. The second unlocked position can facilitate a no-valve-lift mode in which the first cam lever 12 is rotationally displaced about the pivot axis 11 by the camshaft 80 independently from the second valve lever 14, which remains stationary. While in the no valve lift or deactivation mode, the first and second lost motion springs 16A, 16B provide a force that can: 1). act upon the first cam lever 12 via first and second retainer apertures 27A, 27B, controlling the motion of the first cam lever 12 such that separation with the camshaft does not occur at a maximum deactivation speed, and 2). act upon the second valve lever 14 via the first and second retainer slots 53A, 53B to prevent a pump-up or extended length condition of the valve interface 20, such as the shown hydraulic lash adjuster, which could hinder the switching function of the switchable rocker arm 10.

FIG. 6C shows the switchable rocker arm 10 with the locking part 41 in the second unlocked position, and the first cam lever 12 rotated to depict a lost motion position where the camshaft 80 rotates the first cam lever 12, while the second lever 14 remains stationary and does not actuate the engine valve 90.

FIGS. 6A through 6C depict a "disengaged-locked" arrangement for the locking part 41, defined by when the protrusion 62 of the pivot 60 is not engaged with the resilient finger 50 of the switchable rocker arm 10, the first locked position is achieved (see FIG. 6A). Furthermore, the second unlocked position is achieved when the protrusion 62 of the pivot 60 engages the resilient finger 50, causing radially outwardly displacement of the locking pin 34 and the adjacent shuttle pin 36.

Figure 7A:
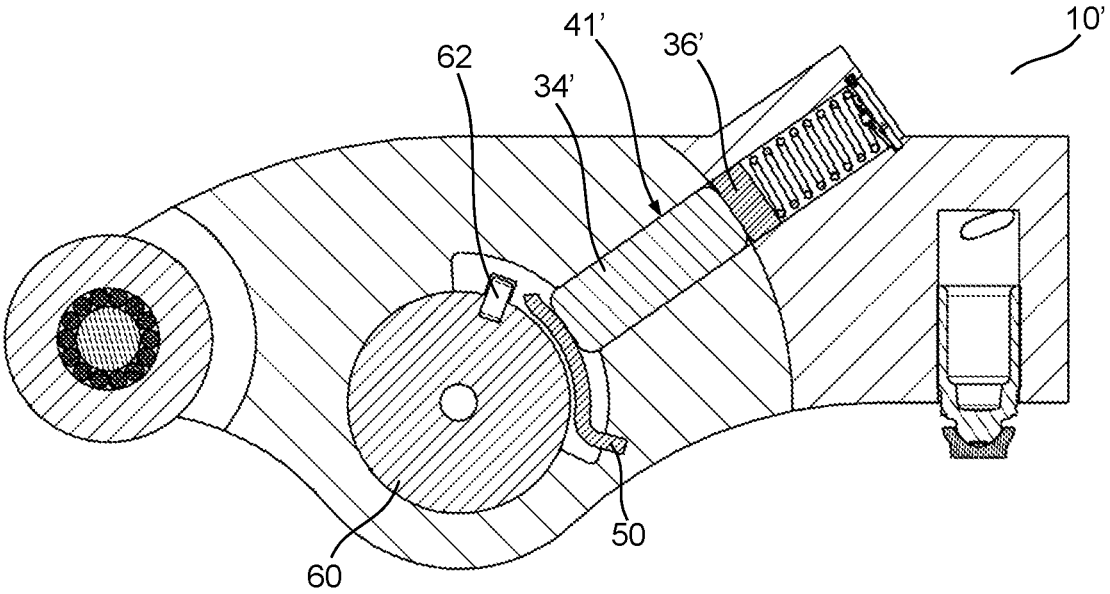
FIG. 7A is a cross-sectional view of a switchable rocker arm with a disengaged-unlocked locking part arrangement in the second unlocked position.
Figure 7B:
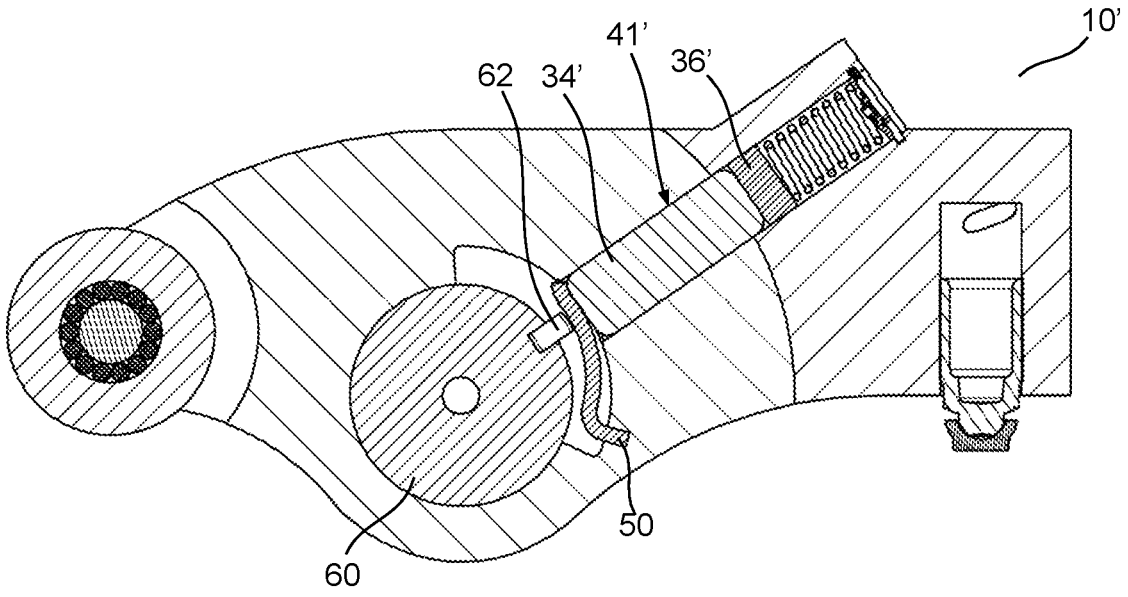
FIG. 7B is a cross-sectional view of the switchable rocker arm of FIG. 7A with the disengaged-unlocked locking part arrangement in the first locked position.

FIGS. 7A and 7B depict an "engaged-locked" arrangement for a locking part 41', defined by when the protrusion 62 of the pivot 60 is engaged with the resilient finger 50 of the switchable rocker arm 10', the first locked position is achieved (see FIG. 7B). Furthermore, the second unlocked position is achieved when the protrusion 62 of the pivot 60 disengages the resilient finger 50, causing radially inwardly displacement of a locking pin 34' and an adjacent shuttle pin 36' (see FIG. 7A).

Figure 8:
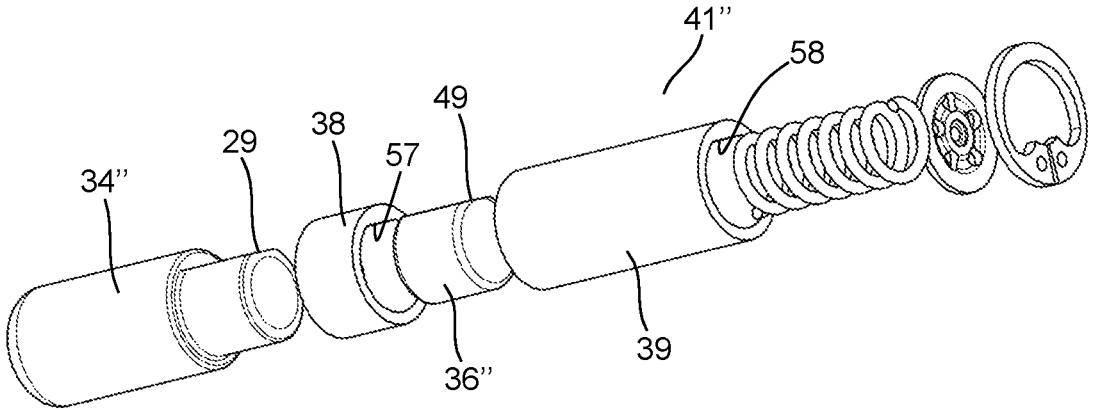
FIG. 8 is a perspective view of a locking part embodiment.
Figure 9:
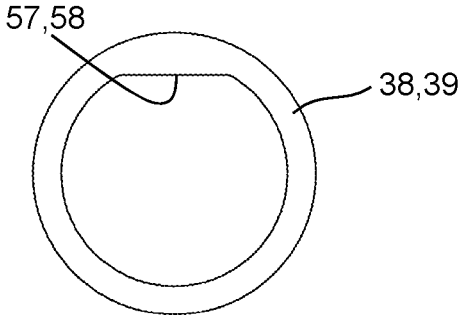
FIG. 9 is an end view of a shuttle pin bushing and locking pin bushing of the locking part of FIG. 8.

Referring to FIG. 8, an embodiment of a locking part 41" is shown that includes a locking pin 34" configured with a first flat 29, a locking pin bore sleeve 38 configured with a second flat 57, a shuttle pin 36" configured with a third flat 49, and a shuttle pin bore sleeve 39 configured with a fourth flat 58. The locking part 41" can provide a flat locking interface between the first cam lever 12 and the second valve lever 14. In the first locked position, the third flat 49 of the shuttle pin 36" engages the second flat 57 of the locking pin bore sleeve 38 and the fourth flat 58 of the shuttle pin bore sleeve 39 (see FIG. 12). For clarity purposes, FIG. 9 shows an end view of the locking pin bore sleeve 38 and the shuttle pin bore sleeve 39, which have identical end views. However, it could be possible that the locking pin bore sleeve 38 and the shuttle pin bore sleeve 39 do not have duplicative end views, as shown in FIG. 9.

FIG. 4 shows an isometric exploded view of the pivot 60 in the form of a rocker shaft. The protrusion 62 is shown displaced from a protrusion receiving aperture 63 that fixes the protrusion 62 to the pivot 60. Other forms of the protrusion 62 and its attachment to the pivot 60 are also possible. The pivot 60 is configured with an outer recess 43 that fluidly connects the radial fluid passage 44 of the pivot 60 to the lever fluid passage 42 of the switchable rocker arm 10 throughout at least a portion of an angular range of rotation of one or both of the pivot 60 and the switchable rocker arm 10.

FIG. 5 shows an isometric view of a rotary actuator 100, controlled by an electronic controller 70, together with the pivot 60 and switchable rocker arm 10. The electronic controller 70 communicates electronically with the rotary actuator 100 to move the pivot 60 in either a first direction D1 or a second direction D2 to any desired rotational position within a continuous range of rotational positions. Stated otherwise, a rotary position of the pivot is continuously variable. The rotary actuator 100 is non-rotatably connected to the shaft via a coupling 98 that translates rotary motion of the actuator 100 to rotary motion of the pivot 60. The term "non-rotatably connected" is meant to signify two elements that are directly or indirectly connected in a way that whenever one of the elements rotate, both of the elements rotate in unison, such that relative rotation between these elements is not possible. Radial and/or axial movement or offset of non-rotatably connected elements with respect to each other is possible, but not required.

Figure 10A:
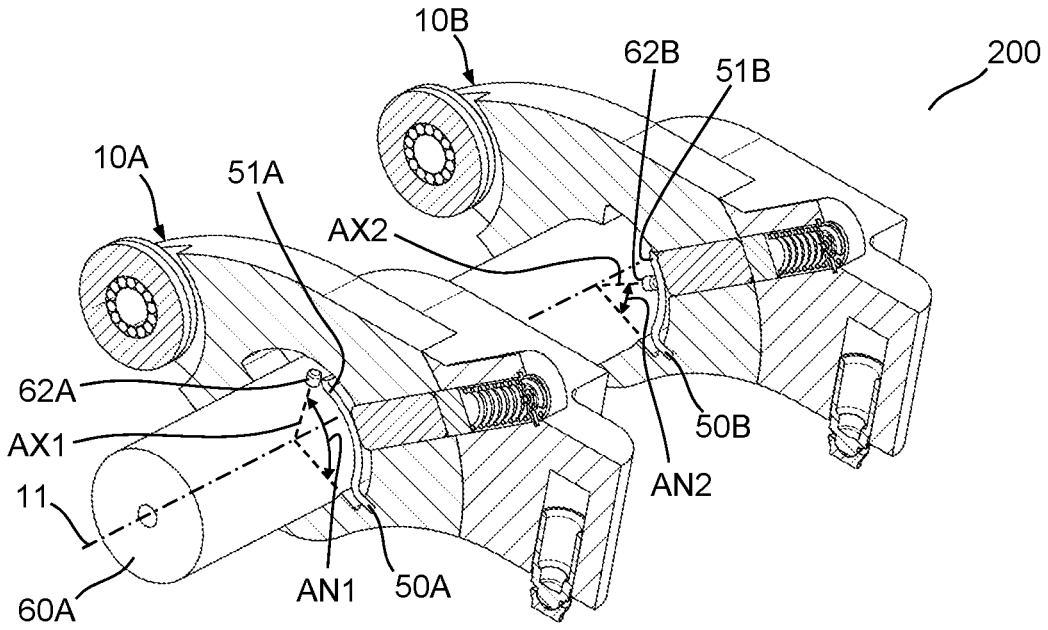
FIG. 10A is a cross-sectional perspective view of a switchable rocker arm arrangement in a first rotational position of a pivot.
Figure 10B:
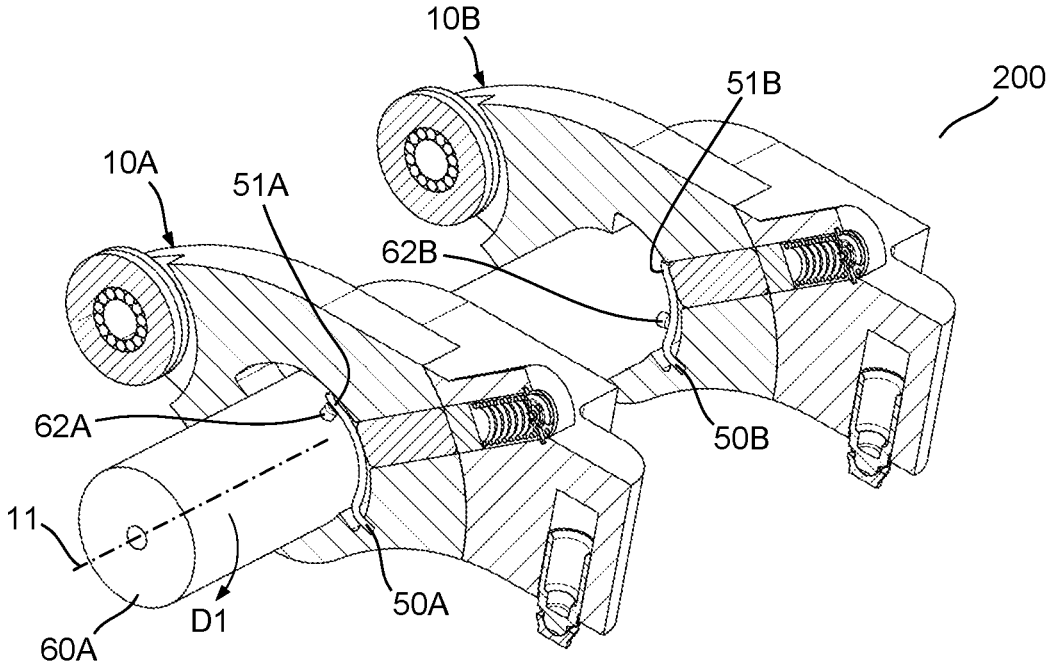
FIG. 10B is a cross-sectional perspective view of the switchable rocker arm arrangement of FIG. 10A in a second rotational position of the pivot.

FIGS. 10A and 10B show a tandem switchable rocker arm and pivot arrangement 200 that includes a first switchable rocker arm 10A, a second switchable rocker arm 10B, and a pivot 60A. The first switchable rocker arm 10A includes a first resilient finger 50A that interacts with a first protrusion 62A arranged on the pivot 60A to selectively lock and unlock the first switchable rocker arm 10A. The second switchable rocker arm 10B includes a second resilient finger 50B that interacts with a second protrusion 62B arranged on the pivot 60A to selectively lock and unlock the second switchable rocker arm 10B. As shown in FIG. 10A, a first axis AX1 extends from the center of the first protrusion 62A and intersects the pivot axis 11 at a first angle AN1. A second axis AX2 extends from the center of the second protrusion 62B and intersects the pivot axis 11 at a second angle AN2. The second angle AN2 is different than the first angle AN1. The different angular locations AN1, AN2 of the first and second protrusions 62A, 62B can facilitate different angular engagement positions of the first and second protrusions 62A, 62B and respective first and second resilient fingers 50A, 50B. FIG. 10A shows the pivot 60A in a first angular position in which the first protrusion 62A is not engaged with the first resilient finger 50A, while the second protrusion 62B is engaged with the second resilient finger 50B. FIG. 10B shows the pivot 60A in a second angular position in which the pivot 60A is rotated in the first direction D1 from the first angular position shown in FIG. 10A. In this second angular position, both of the first and second protrusions 62A, 62B are engaged with respective first and second resilient fingers 50A, 50B.

The first resilient finger 50A has a first distal end 51A that extends further circumferentially than a second distal end 51B of the second resilient finger 50B. This extended first distal end 51A facilitates an engagement between the first protrusion 62A and the first resilient finger 50A over a longer circumferential distance than an engagement between the second protrusion 62B and the second resilient finger 50B.

Figure 11:
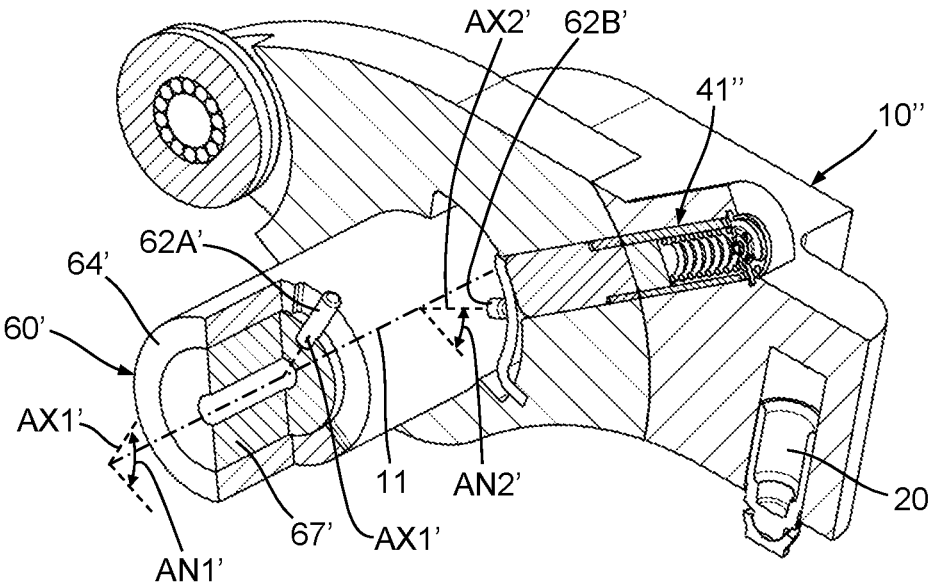
FIG. 11 is a cross-sectional perspective view of a switchable rocker arm arrangement together with a pivot having an inner shaft and an outer shaft with protrusions located at different angular locations.
Figure 13:
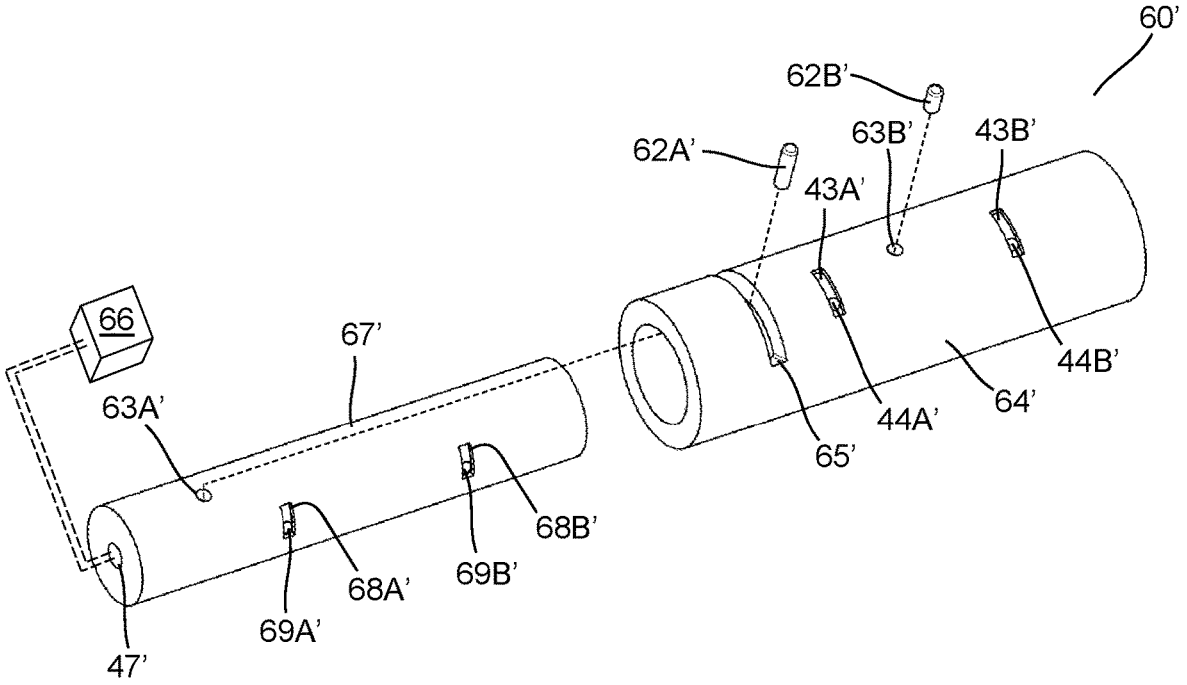
FIG. 13 is an exploded perspective view of the pivot of FIG. 11.

FIG. 11 shows a perspective view of an embodiment of a pivot 60' together with a switchable rocker arm 10" configured with the previously described locking part 41" in the second unlocked position. FIG. 13 shows an exploded perspective view of the pivot 60'. With view to FIGS. 11 and 13, the pivot 60' includes an outer shaft 64' and an inner shaft 67' that are each rotatable relative to the other and can each be separately actuated. The pivot 60' includes a first protrusion 62A' that is connected to the inner shaft 67' via a first protrusion aperture 63A'; the first protrusion 62A' extends through a circumferential slot 65' of the outer shaft 64'. The pivot 60' also includes a second protrusion 62B' that is connected to the outer shaft 64' via a second protrusion aperture 63B'. Upon rotation of the inner shaft 67' or the outer shaft 64' relative to the other, the first protrusion 62A' can move back and forth within the circumferential slot 65'. A first axis AX1' extends from the center of the first protrusion 62A' and intersects the pivot axis 11 at a first angle AN1'. For clarity purposes, the first angle AN1' is shown at an end of the pivot axis 11 within FIG. 11. A second axis AX2' extends from the center of the second protrusion 62B' and intersects the pivot axis 11 at a second angle AN2'. The second angle AN2' is different than the first angle AN1'. The different angular locations AN1', AN2' of the first and second protrusions 62A', 62B' can facilitate different angular engagement positions of the first and second protrusions 62A', 62B' and respective resilient fingers.

As shown in FIGS. 3B and 13, the pivot 60' is configured with multiple fluid passages and features to fluidly connect the pressurized hydraulic fluid source 66 to the lever fluid passage 42. The outer shaft 64' is configured with first and second outer recesses 43A', 43B' that fluidly connect the lever fluid passage 42 to first and second outer radial fluid passages 44A', 44B'. The first and second outer recesses 43A', 43B' also fluidly connect the outer shaft 64' to the switchable rocker arm 10, 10', 10" throughout at least a portion of an angular range of rotation of one or both of the pivot 60 and the switchable rocker arm 10, 10', 10". The inner shaft 67' is configured with first and second inner recesses 68A', 68B', first and second inner radial fluid passages 69A', 69B', and an inner axial fluid passage 47' to complete a fluid circuit from the pressurized hydraulic fluid source 66 to the switchable rocker arm 10, 10', 10". The first and second inner recesses 68A', 68B' fluidly connect the inner shaft 67' to the outer shaft 64' throughout at least a portion of an angular range of relative rotation between the inner shaft 67' and the outer shaft 64'.

Figure 12:
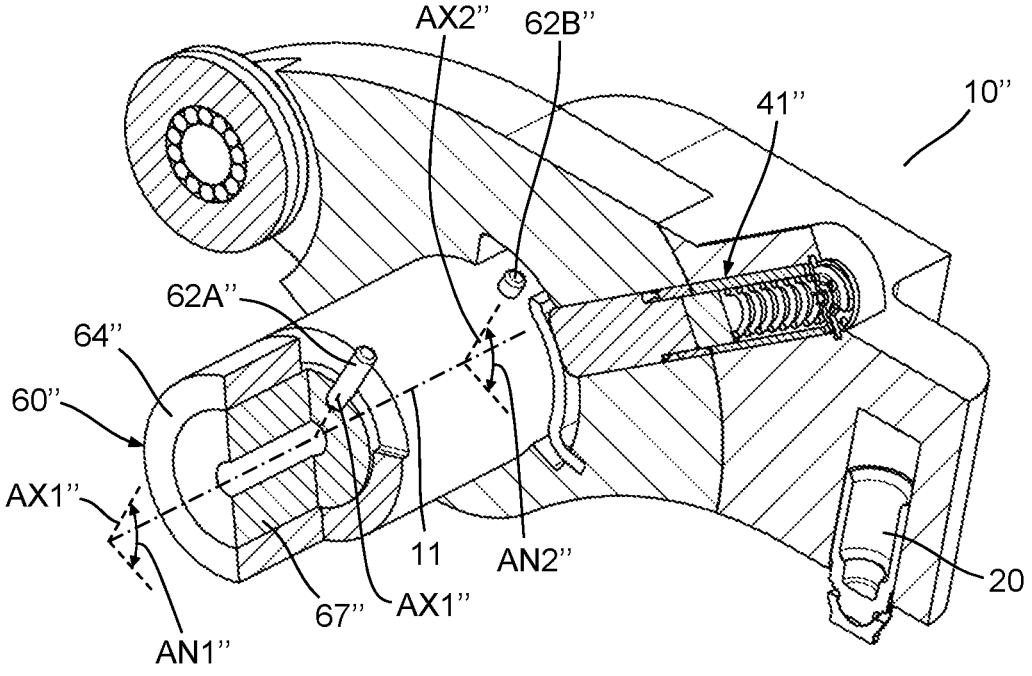
FIG. 12 is a cross-sectional perspective view of a switchable rocker arm arrangement together with a pivot having an inner shaft and an outer shaft with protrusions located at the same angular position.

FIG. 12 shows a perspective view of an embodiment of a pivot 60" together with the switchable rocker arm 10" of FIG. 11, but with the locking part 41" in the first locked position. The pivot 60" includes an outer shaft 64" and an inner shaft 67" that are rotatable relative to each other and can each be separately actuated. As with the pivot 60' of FIGS. 11 and 13, the pivot 60" includes a first protrusion 62A" and a second protrusion 62B" that are connected to respective inner and outer shafts 67", 64". A first axis AX1" of the first protrusion 62A" intersects the pivot axis 11 at a first angle AN1", and a second axis AX2" of the second protrusion 62B" intersects the pivot axis 11 at a second angle AN2"; however, in this embodiment of the pivot 60", the first angle AN1" is equal to the second angle AN2".

While FIGS. 10A through 13 show a shaft arrangement that can accommodate two rocker arms, a larger number of rocker arms could be accommodated with an increased number of protrusions. The protrusions could be arranged in various angular locations including, but not limited to, those shown in the figures.

Figure 14:
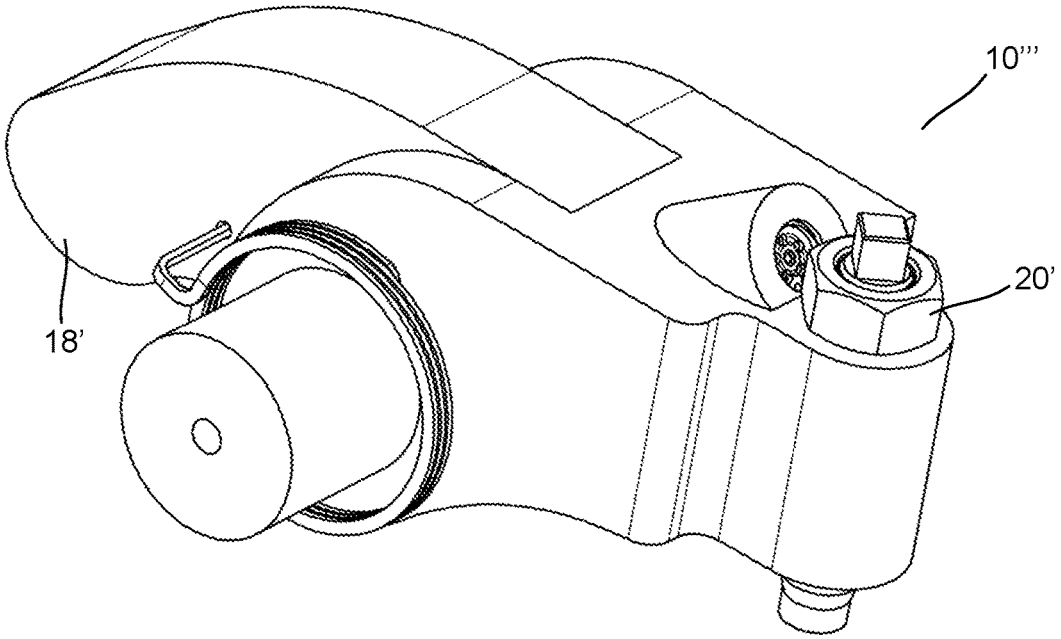
FIG. 14 is a perspective view of an example embodiment of a switchable rocker arm with alternative camshaft and valve interfaces.

Referring to FIG. 14, an embodiment of a switchable rocker arm 10'" is shown that utilizes an alternative valve interface 20' in the form of an adjusting screw assembly, and an alternative cam interface 18' in the form of a slider pad. Utilizing one or both of these alternative interfaces 20', 18' can reduce the complexity and cost of the switchable rocker arm 10'".

Having thus described various embodiments of the present switchable rocker arm in detail, it is to be appreciated and will be apparent to those skilled in the art that many physical changes, only a few of which are exemplified in the detailed description above, could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A switchable rocker arm comprising:

a first lever arranged to be rotated by a camshaft about a pivot;

a second lever arranged to actuate an engine valve; and, a locking part arranged to selectively lock the first lever to the second lever, the locking part arranged to be mechanically actuated by a protrusion fixed both radially and axially on the pivot.

2. The switchable rocker arm of claim 1, wherein:

the first lever comprises:

a first cam end with a cam interface;

a second locking end; and, the second lever comprises:

a first pivot end; and, a second valve end.

3. The switchable rocker arm of claim 2, wherein the second valve end includes a hydraulic lash adjuster.

4. The switchable rocker arm of claim 2, wherein:

the first lever further comprises a cam pivot interface arranged between the first cam end and the second locking end; and, the second lever further comprises a first arm with a first pivot interface and a second arm with a second pivot interface, the cam pivot interface axially aligned with the first and second pivot interfaces.

5. A switchable rocker arm comprising:

a first lever arranged to be rotated by a camshaft about a pivot;

a second lever arranged to actuate an engine valve; and, a locking part arranged to selectively lock the first lever to the second lever, the locking part arranged to be actuated by rotation of the pivot.

6. The switchable rocker arm of claim 5, having:

a first locked position with the first lever locked to the second lever, defining a first lift mode; and, a second unlocked position with the first lever unlocked from the second lever, defining a second lift mode.

7. The switchable rocker arm of claim 6, wherein the first lift mode is a full-valve-lift mode, and the second lift mode is a no-valve-lift mode.

8. The switchable rocker arm of claim 5, wherein the locking part comprises a locking pin, a shuttle pin and a bias spring.

9. The switchable rocker arm of claim 8, wherein at least one of the locking pin or shuttle pin includes a flat configured to engage the first or second lever.

10. The switchable rocker arm of claim 8, wherein the locking pin is arranged at least partially within a locking pin bore of the first lever, and the shuttle pin is arranged at least partially within a shuttle pin bore of the second lever, the locking pin engaging the shuttle pin.

11. The switchable rocker arm of claim 10, further comprising a resilient finger arranged at a first end of the locking pin bore, the resilient finger configured to actuate the locking pin upon rotation of the pivot.

12. A valve train system comprising:

a pivot shaft;

at least one first switchable rocker arm arranged to rotate about the pivot shaft, the at least one first switchable rocker arm having a first locking part arranged to be mechanically actuated by a first protrusion of the pivot shaft; and, at least one second switchable rocker arm arranged to rotate about the pivot shaft, the at least one second switchable rocker arm having a second locking part arranged to be mechanically actuated by a second protrusion of the pivot shaft; and, the first protrusion arranged at a first angular position, and the second protrusion arranged at a second angular position, different than the first angular position.

13. The valve train system of claim 12, wherein the shaft comprises an outer shaft and an inner shaft, the outer shaft including the first protrusion, and the inner shaft including the second protrusion.

14. The valve train system of claim 13, wherein the outer shaft rotates so as to mechanically actuate the at least one first switchable rocker arm, and the inner shaft rotates so as to mechanically actuate the at least one second switchable rocker arm.

15. The valve train system of claim 14, wherein the at least one first switchable rocker arm comprises a first lever and a second lever, and the first locking part selectively locks the first lever to the second lever.

16. The valve train system of claim 15, wherein the first locking part comprises a locking pin, a shuttle pin, and a bias spring.

17. The valve train system of claim 16, wherein the locking pin is arranged at least partially within a locking pin bore of the first lever, and the shuttle pin is arranged at least partially within a shuttle pin bore of the second lever, the shuttle pin engaging the locking pin.

18. The valve train system of claim 15, including:

a first locked position with the first lever locked to the second lever, defining a first lift mode; and, a second unlocked position with the first lever unlocked from the second lever, defining a second lift mode.

* * * * *